US008339902B2

(12) United States Patent
Muraji

(10) Patent No.: US 8,339,902 B2
(45) Date of Patent: Dec. 25, 2012

(54) CLOCKWORK MECHANISM AND CLOCKWORK TIMEPIECE

(75) Inventor: Toyonori Muraji, Tokyo (JP)

(73) Assignee: Seiko Clock Inc., Tokyo (JP)

( * ) Notice: Subject to any disclaimer, the term of this patent is extended or adjusted under 35 U.S.C. 154(b) by 427 days.

(21) Appl. No.: 12/764,303

(22) Filed: Apr. 21, 2010

(65) Prior Publication Data

US 2011/0019507 A1 Jan. 27, 2011

(30) Foreign Application Priority Data

Jul. 27, 2009 (JP) ..... 2009-174118

(51) Int. Cl.
*G04B 19/04* (2006.01)

(52) U.S. Cl. ..... 368/223; 368/228; 368/272

(58) Field of Classification Search ..... 368/72–75, 368/220, 272
See application file for complete search history.

(56) References Cited

U.S. PATENT DOCUMENTS

| | | | | |
|---|---|---|---|---|
| 4,941,137 | A * | 7/1990 | Kikuchi | 368/223 |
| 5,161,130 | A * | 11/1992 | Sato et al. | 368/228 |
| 6,229,768 | B1 * | 5/2001 | Nakazawa et al. | 368/223 |
| 6,262,947 | B1 * | 7/2001 | Pulver | 368/223 |
| 7,339,855 | B2 * | 3/2008 | Muraji | 368/223 |
| 7,420,885 | B2 * | 9/2008 | Claret et al. | 368/265 |
| 7,477,574 | B2 * | 1/2009 | Takiguchi | 368/75 |
| 7,480,213 | B2 * | 1/2009 | Muraji | 368/223 |
| 7,564,742 | B2 * | 7/2009 | Muraji | 368/228 |

FOREIGN PATENT DOCUMENTS

JP 9-332 6/1997

OTHER PUBLICATIONS

Office Action issued on Oct. 11, 2011 in the corresponding Japanese Patent Application No. 2009-174118 with English translation.

* cited by examiner

*Primary Examiner* — Renee Luebke
*Assistant Examiner* — Jason Collins
(74) *Attorney, Agent, or Firm* — Kratz, Quintos & Hanson, LLP

(57) ABSTRACT

A clockwork mechanism includes: a supporting member; a movable member including an engagement hole and movably supported by the supporting member; a drive pin engaging the engagement hole, including a flange portion for preventing the drive pin from disengaging from the engagement hole, and revolving to move the movable member; a biasing member provided in the movable member to partially overlap the engagement hole; and an abutment member abutting the movable member to restrict the movement of the movable member. The flange portion overlaps or does not overlap the biasing member depending on a revolving position of the drive pin. When the movable member abuts the abutment member, the drive pin pushes the biasing member and the movable member is biased toward the abutment member by the biasing member. When the flange portion does not overlap the biasing member, the drive pin moves the movable member to push the biasing member, allowing the drive pin to disengage from the engagement hole.

4 Claims, 11 Drawing Sheets

CLOCKWORK MECHANISM AND CLOCKWORK TIMEPIECE

CROSS-REFERENCE TO RELATED APPLICATION

This application is based upon and claims the benefit of priority of the prior Japanese Patent Application No. 2009-174118, filed on Jul. 27, 2009, the entire contents of which are incorporated herein by reference.

BACKGROUND (i) Technical Field

The present invention relates to a clockwork mechanism and a clockwork timepiece.

(ii) Related Art

Japanese Unexamined Utility Model Application Publication No. 9-332 discloses a timepiece having movable dial plates openable and closeable. In response to the opening or closing of the movable dial plates, an ornament is exposed or covered. The movable dial plates stop with abutting each other. To prevent any displacement of the movable dial plate in the stop state, plate springs bias the movable dial plates so as to maintain the abutment of the movable dial plates. The plate spring is pushed by a cam pin for moving the movable dial plate so as to bias the movable dial plate.

The movable dial plate is slidably disposed on a supporting plate via a slider. This manner suppresses rattling of the movable dial plates in a direction crossing the planer direction in which the movable dial plates move.

The above timepiece is provided with a member for causing the plate spring to have a biasing force and another member for preventing the rattling of the movable dial plate, separately. For this reason, the number of the parts is increased. Further, it is preferable to easily attach or remove the movable dial plates to or from the supporting plate at the time of assembling or disassembling.

It is therefore an object of the present invention to provide a clockwork mechanism and a clockwork timepiece that reduces the number of parts and improves workability of assembling and disassembling.

SUMMARY

According to an aspect of the present invention, there is provided a clockwork mechanism including: a supporting member; a movable member including an engagement hole and movably supported by the supporting member; a drive pin engaging the engagement hole, including a flange portion for preventing the drive pin from disengaging from the engagement hole, and revolving to move the movable member; a biasing member provided in the movable member to partially overlap the engagement hole; and an abutment member abutting the movable member to restrict the movement of the movable member, wherein: the flange portion overlaps or does not overlap the biasing member depending on a revolving position of the drive pin; when the movable member abuts the abutment member, the drive pin pushes the biasing member and the movable member is biased toward the abutment member by the biasing member; and when the flange portion does not overlap the biasing member, the drive pin moves the movable member to push the biasing member, allowing the drive pin to disengage from the engagement hole.

According to another aspect of the present invention, there is provided a clockwork timepiece including the above clockwork mechanism.

DETAILED DESCRIPTION

In the following, a description will be given of a clockwork mechanism and a clockwork timepiece according to the embodiment.

Figure 1A:
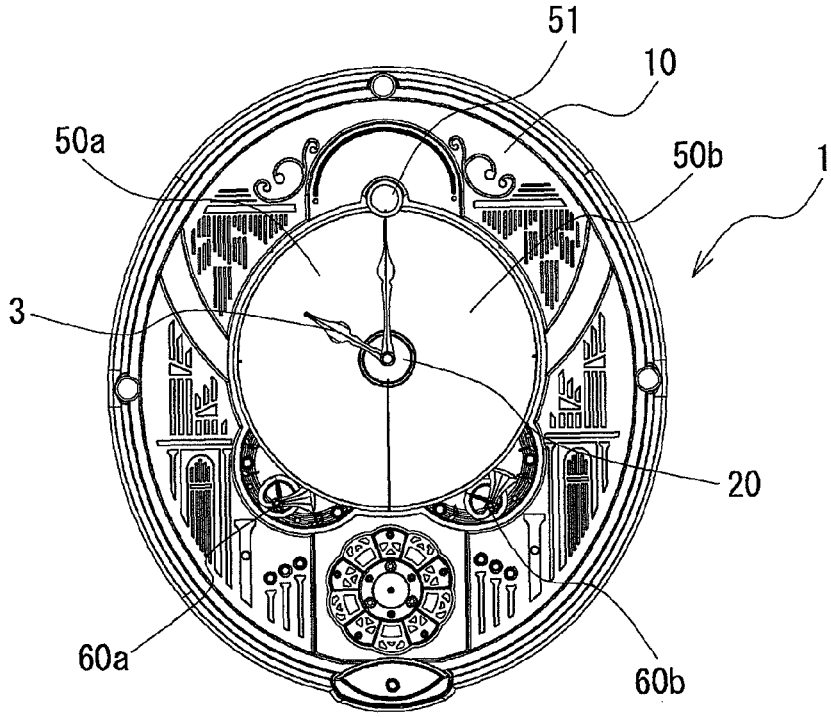
FIGS. 1A and 1B are front views of a clockwork timepiece.
Figure 1B:
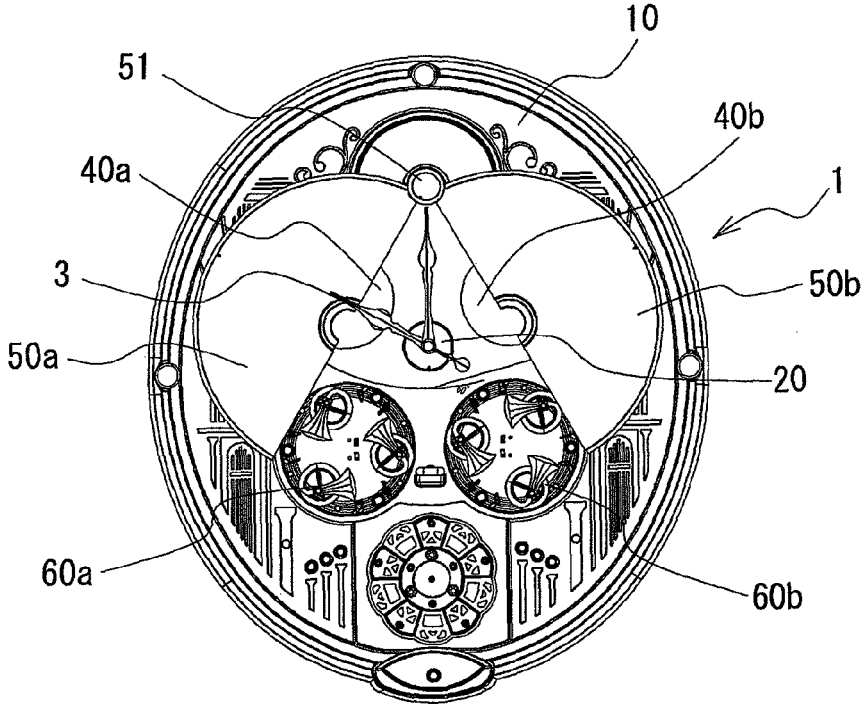

FIGS. 1A and 1B are front views of the clockwork timepiece. The clockwork timepiece 1 includes: hands 3 indicating time; a supporting plate 10; dial plates 50*a* and 50*b* movably supported by the supporting plate 10; rotary plates 60*a* and 60*b* exposed or partially covered in response to the movements of the dial plates 50*a* and 50*b*. The surfaces of the rotary plates 60*a* and 60*b* are decorated. In a normal state, the dial plates 50*a* and 50*b* close as illustrated in FIG. 1A. When a predetermined time has come, the dial plates 50*a* and 50*b* open as illustrated in FIG. 1B and the rotary plates 60*a* and 60*b* rotate. In this manner, the clockwork timepiece 1 performs at a predetermined time.

The dial plates 50*a* and 50*b* are connected to each other via a hinge portion 51. Each of the dial plates 50*a* and 50*b* is swingable about the hinge portion 51 and is a movable member with a semicircle shape. A dial plate 20 is secured to the supporting plate 10 and does not move. The hands 3 are connected to the center of the dial plate 20. The dial plate 20 has a circular shape. The hands 3 are moved by a movement not illustrated. While the performance is not conducted, the entire of the dial plates 50*a*, 50*b*, and 20 function as a single dial plate.

Figure 2:
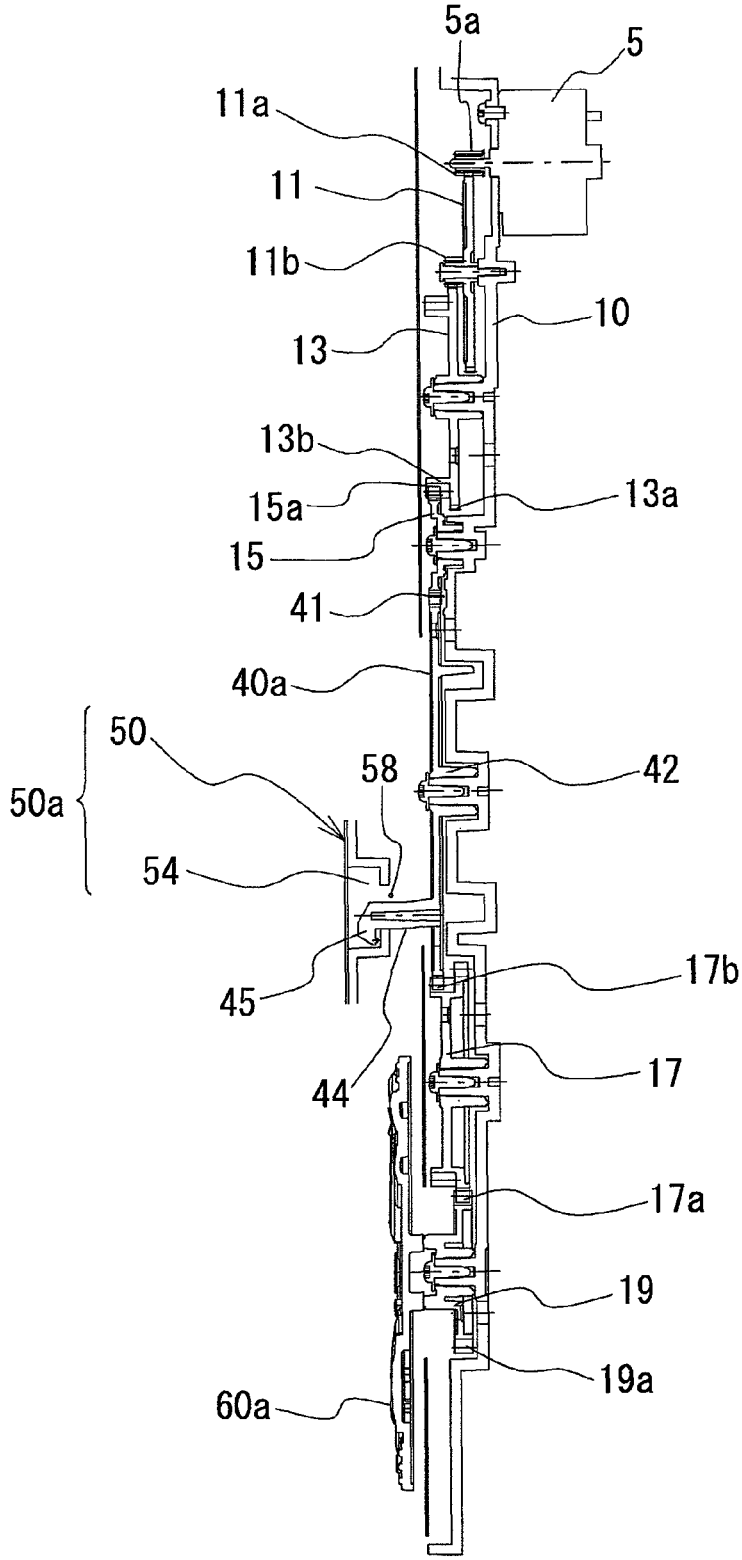
FIG. 2 is a cross sectional view of the clockwork timepiece.

An internal structure of the clockwork timepiece 1 will be described. FIG. 2 is a cross sectional view of the clockwork timepiece. A motor 5 is disposed behind the supporting plate 10. The rotary shaft of the motor 5 extends to the front side of the supporting plate 10. A pinion gear 5*a* is press fitted on the motor 5. The pinion gear 5*a* meshes a teeth portion 11*a* of a gear 11. The gear 11 includes the teeth portion 11*a*, and a teeth portion 11*b* having a diameter smaller than that of the teeth portion 11*a*. The teeth portion 11*b* meshes a teeth portion 13*a* of a gear 13. The gear 13 includes the teeth portion 13*a*, and a teeth portion 13*b* having a diameter smaller than that of the teeth portion 13*a*. The teeth portion 13*b* meshes a teeth portion 15*a* of a gear 15. The teeth portion 15*a* meshes a teeth portion 41 of a gear 40*a*.

The gear 40*a* includes a drive pin 44, as will be described later in detail, provided apart from a shaft 42. The drive pin 44 is provided at its end with a flange portion 45. The flange portion 45 extends to the outside of the gear 40*a*. The drive pin 44 engages an engagement hole 54 provided in the dial plate 50*a*. The flange portion 45 prevents the drive pin 44 from disengaging from the engagement hole 54. In addition, the flange portion 45 is integrally formed in the drive pin 44. The gears 40*a* and 40*b* are made of plastic.

The teeth portion 41 meshes a teeth portion 17*b* of a gear 17. The gear 17 includes a teeth portion 17*a* having a diameter larger than that of the teeth portion 17*b*. The teeth portion 17*a* meshes a teeth portion 19*a* of a gear 19. The gear 19 is secured to the rotary plate 60*a* in a concentric manner. The above gears are rotatably supported by the supporting plate 10.

At the time of performance, the motor 5 rotates at a constant speed, so the gears rotate. The drive force of the motor 5 is decelerated to be transmitted to each gear. The rotation of the gear 40*a* causes the drive pin 44 to revolve about the shaft 42. In this way, the dial plate 50*a* drives. Also, the drive force of the motor 5 is transmitted to the gear 40*b* via the gears. Thus, during the performance, the gears 40*a* and 40*b* rotate at a constant speed.

Figure 3A:
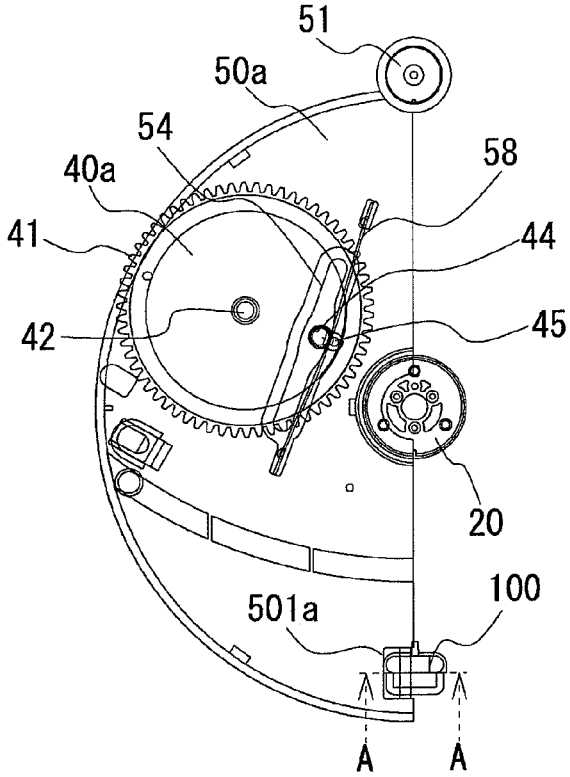
FIGS. 3A and 3B are explanatory views of opening and closing actions.

Next, the opening and closing action of the dial plates 50*a* and 50*b* will be described. FIGS. 3A to 9 are explanatory views of the opening and closing action. FIG. 3A illustrates the closing state where the dial plate 50*a* closes. Additionally, the dial plate 50*b* has the same configuration as that of the dial plate 50*a*, so the description thereof will be omitted.

As illustrated in FIG. 3A, the dial plate 50*a* is provided with the engagement hole 54 having an oblong hole shape. Further, behind the dial plate 50*a*, a linear spring 58 is disposed along the engagement hole 54. The both ends of the linear spring 58 are secured to the rear side of the dial plate 50*a*. Furthermore, FIG. 1 illustrates the state where the engagement hole 54 is covered with a cosmetic plate 50 disposed on the front surface of the dial plate 50*a*. Moreover, in FIGS. 3A to 9, the cosmetic plate 50 is omitted, so that the dial plate 50*a* is illustrated to overlap the configurations disposed behind the cosmetic plate 50, the gear 40*a*, and the like, for convenience.

Figure 3B:
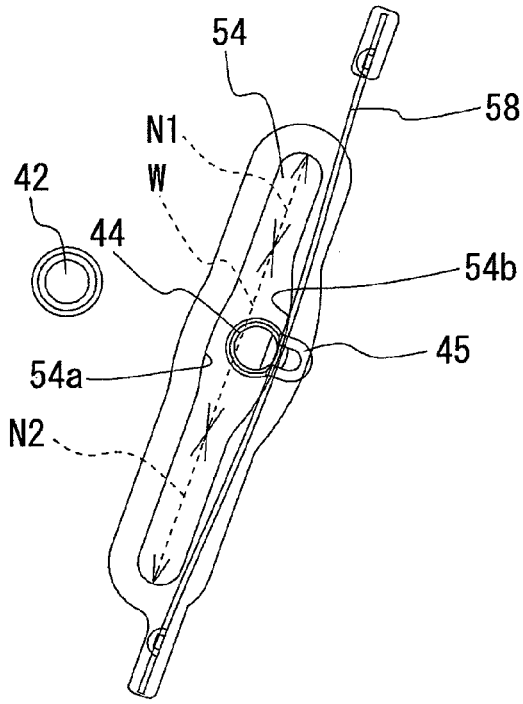

FIG. 3B is an enlarged view of the engagement hole 54. Additionally, the structures are partially omitted in FIG. 3B. The engagement hole 54 includes narrow areas N1 and N2, and a wide area W positioned between the narrow areas N1 and N2. The narrow areas N1 and N2 are substantially identical to each other in width. The wide area W is wider than each of the narrow areas N1 and N2. The width of the narrow areas N1 or N2 is substantially identical to a diameter of the drive pin 44.

As illustrated in FIGS. 3A and 3B, the linear spring 58 is secured to the dial plate 50*a* so as to be arranged along the inner edges of the narrow areas N1 and N2, the inner edges being continuous with the curved portion 54*b* and being near the center of the dial plate 20. The wide area W is defined by curved portions 54*a* and 54*b* located outside of the inner edges of the narrow areas N1 and N2. The curved portion 54*a* faces the curved portion 54*b*. The curved portion 54*b* is longer than the curved portion 54*a*.

As illustrated in FIG. 3B, in the closing state, the drive pin 44 is located within the wide area W and pushes the linear spring 58 toward the dial plate 50*b* side. Therefore, the linear spring 58 is bent. As will be described later in detail, in the state where the drive pin 44 does not push the linear spring 58, the linear spring 58 has a liner shape and partially overlaps the engagement hole 54.

As mentioned above, in the closing state, the linear spring 58 is bent to have a biasing force. Thus, the dial plate 50*a* is biased toward the dial plate 50*b* by the linear spring 58. The like structure is also employed in the dial plate 50*b*, and the dial plate 50*b* is biased toward the dial plate 50*a* in the closing state.

The biased dial plate 50*a* is kept in its position in the closing state by abutting an abutment portion 501*a* with an abutment portion 101 of a dial plate engagement member 100. Likewise, the dial plate 50*b* is kept in its position in the closing state by abutting the dial plate 50*b* with the abutment portion 101 of the dial plate engagement member 100.

Figure 11:
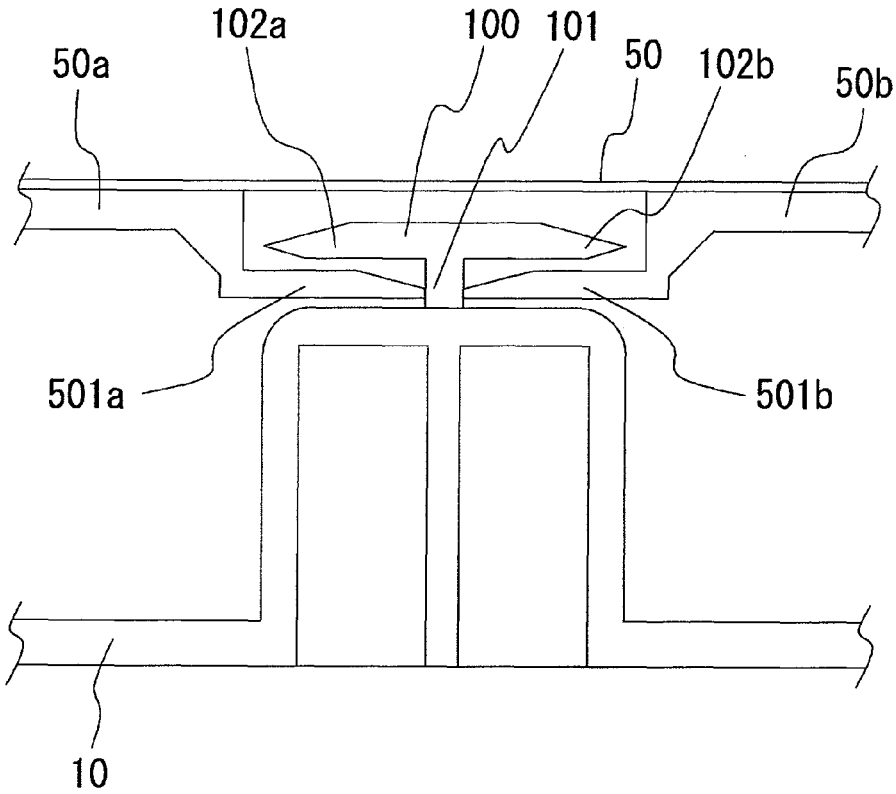
FIG. 11 is a cross sectional view taken along line A-A of FIG. 3A.

FIG. 11 is a cross sectional view taken along line A-A of FIG. 3A. Additionally, FIG. 11 illustrates some components of the structure that are not depicted in FIG. 3A. As illustrated in FIG. 11, by the abutment of the abutment portion 501*a* of the dial plate 50*a* and an abutment portion 501*b* of the dial plate 50*b* with the abutment portion 101 of the dial plate engagement member 100, the dial plates 50*a* and 50*b* are kept in their positions in the closing state. Therefore, a large clearance is prevented from generating between the dial plates 50*a* and 50*b*.

Further, extending wall portions 102*a* and 102*b* are provided above the abutment portion 101 of the dial plate engagement member 100 and extend in the direction parallel to the dial plates 50*a* and 50*b*. In the closing state where the dial plate 50*a* closes, the extending wall portion 102*a* overlaps the abutment portion 501*a*. With such a structure, the dial plate 50*a* is restricted from moving upwardly and downwardly in FIG. 11. Accordingly, the upward and downward movements of the dial plate 50*a*, that is, the rattling of the dial plate 50*a* can be restricted. The same structure also restricts the rattle of the dial plate 50*b*. Herein, the upward and downward movements mean the movements in the front and rear directions of the dial plates 50*a* and 50*b*.

As illustrated in FIG. 3B, when viewed from the front face of the dial plate 50*a*, the flange portion 45 overlaps the linear spring 58. In other words, the flange portion 45 extends outwardly from the gear 40*a*. The clockwork mechanism for the performance includes the dial plates 50*a* and 50*b*, the gears 40*a* and 40*b*, and the linear spring 58.

Figure 4:
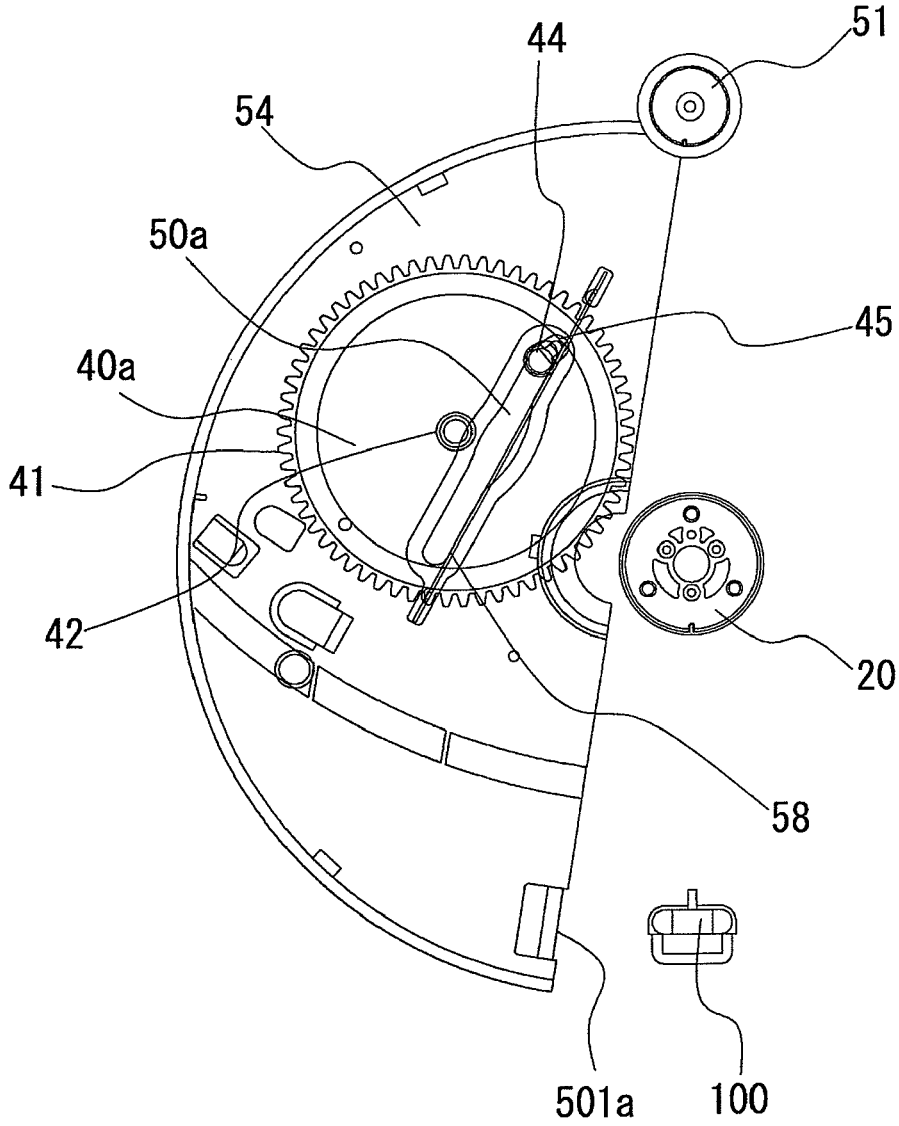
FIG. 4 is an explanatory view of the opening and closing actions.

When the performance starts, the gear 40*a* rotates counterclockwise as illustrated in FIG. 4. Thus, the drive pin 44 moves out of the wide area W into the narrow area N1. Further, the dial plate 50*a* swings about the hinge portion 51 in response to the rotation of the gear 40*a*. That is, the dial plates 50*a* and 50*b* open. The drive pin 44 moves out of the wide area W, so that the shape of the linear spring 58 returns to the liner shape. Further, the flange portion 45 overlaps a peripheral portion of the engagement hole 54. This prevents the drive pin 44 from disengaging from the engagement hole 54. Furthermore, the flange portion 45 does not overlap the linear spring 58 in the state illustrated in FIG. 5A. In this way, the flange portion 45 overlaps or does not overlap the linear spring 58 depending on the rotational position of the gear 40*a*.

Figure 5A:
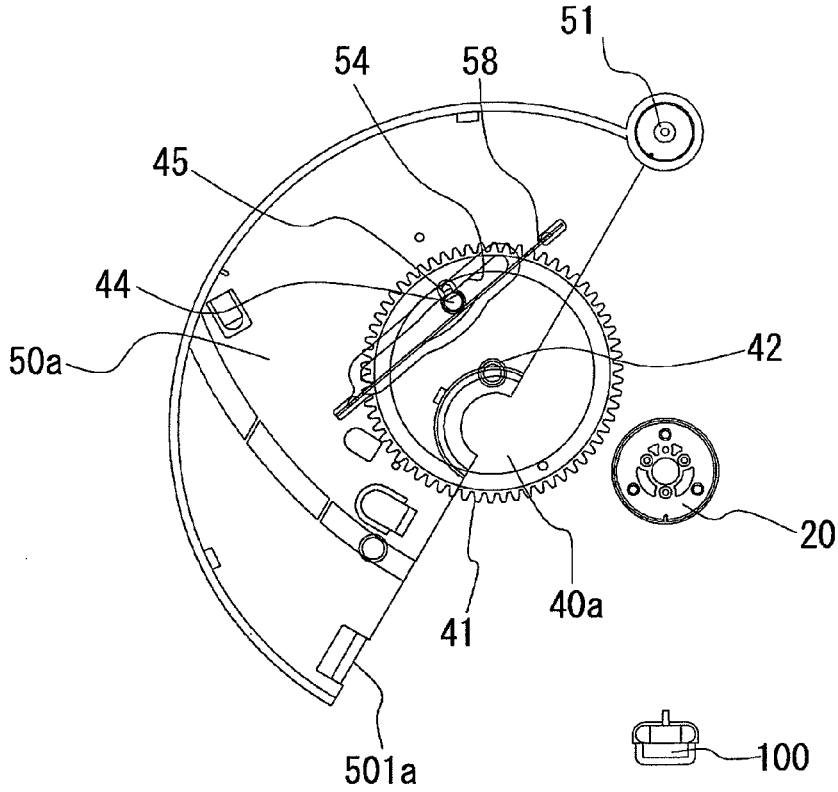
FIGS. 5A and 5B are explanatory views of the opening and closing actions.
Figure 5B:
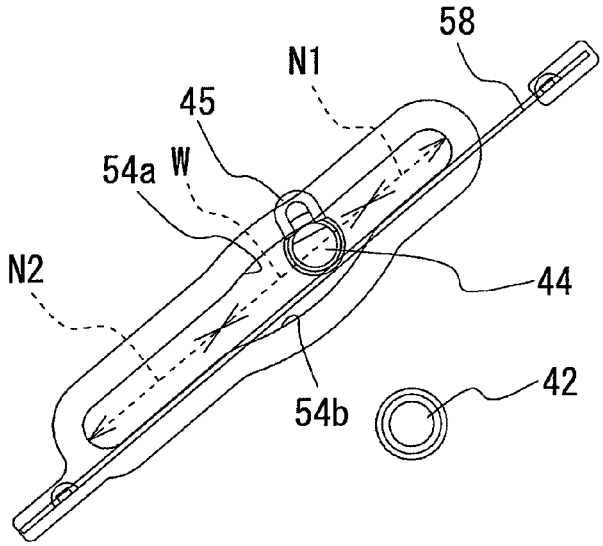

When the gear 40*a* further rotates counterclockwise, the dial plate 50*a* further opens in the fully opening state as illustrated in FIG. 5A. FIG. 5B is an enlarged view of the engagement hole 54 illustrated in FIG. 5A.

Figure 6A:
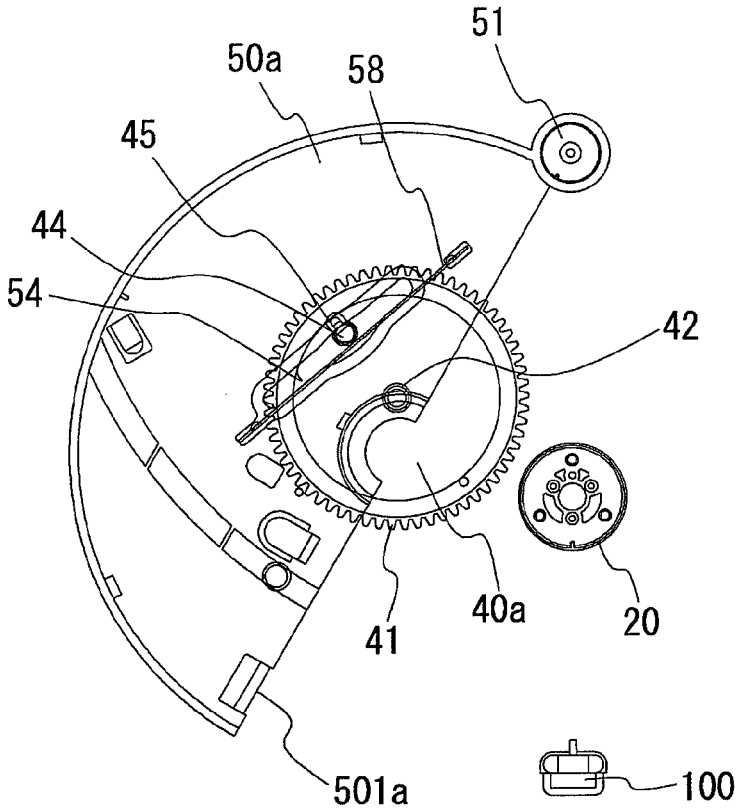
FIGS. 6A and 6B are explanatory views of the opening and closing actions.
Figure 6B:
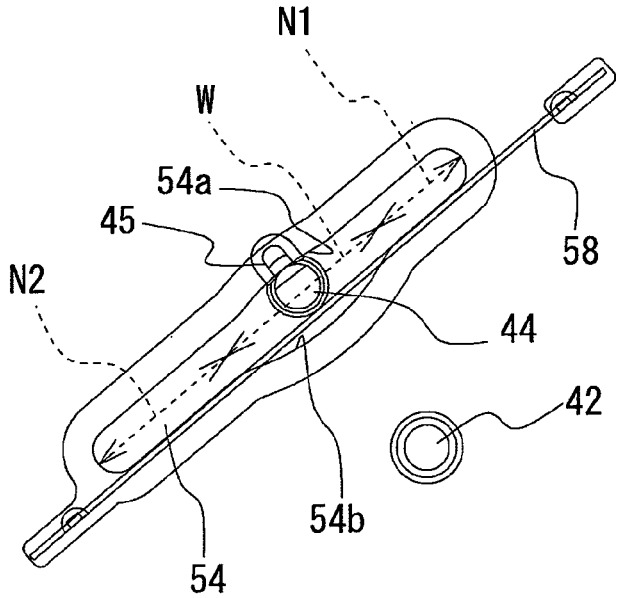
Figure 7A:
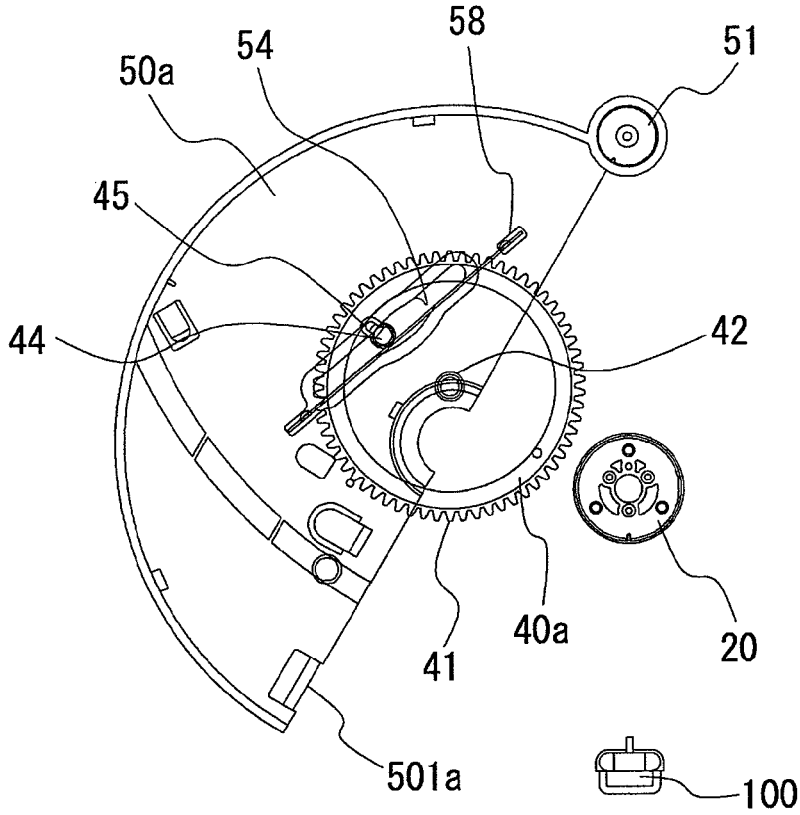
FIGS. 7A and 7B are explanatory views of the opening and closing actions.
Figure 7B:
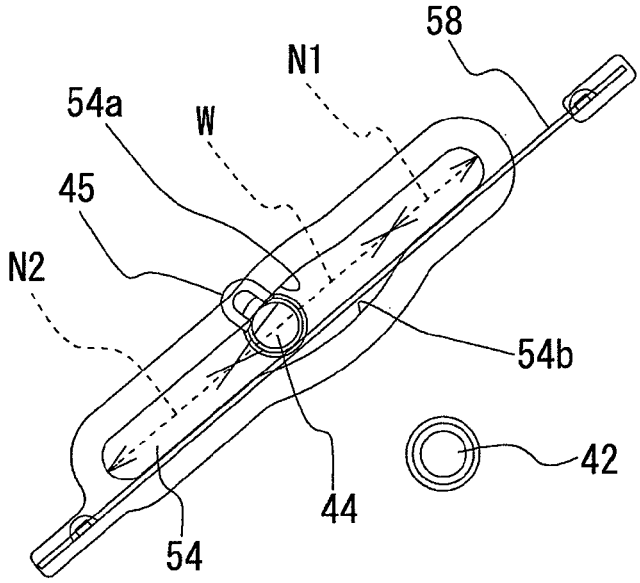

FIGS. 6A and 6B illustrate the state where the gear 40*a* slightly rotates counterclockwise from its position illustrated in FIG. 5A. As illustrated in FIG. 6B, the drive pin 44 is located in the center of the wide area W, and the flange portion 45 faces the outside of the clockwork timepiece 1. FIGS. 7A and 7B illustrate the state where the gear 40*a* slightly rotates counterclockwise from its position illustrated in FIG. 6A.

In the states as illustrated in FIGS. 5A to 7B, the gear 40*a* rotates counterclockwise at a constant speed, whereas the dial plate 50*a* does not move. That is, the curved portion 54*a* is formed so as to escape the revolution of the drive pin 44. In other words, the curvature radius of the curved portion 54*a* is substantially identical to the distance between the shaft 42 and the drive pin 44. In this way, while the drive pin 44 is moving along the curved portion 54*a*, the dial plate 50*a* is in the fully opening state in a predetermined period of time. Consequently, the dial plates 50*a* and 50*b* can be rested in the fully opening state with the simple structure. In addition, as illustrated in FIG. 5A to 7B, the linear spring 58 is not pushed by the drive pin 44 in the fully opening state. Thus, the shape of the linear spring 58 returns to a liner one.

Figure 8:
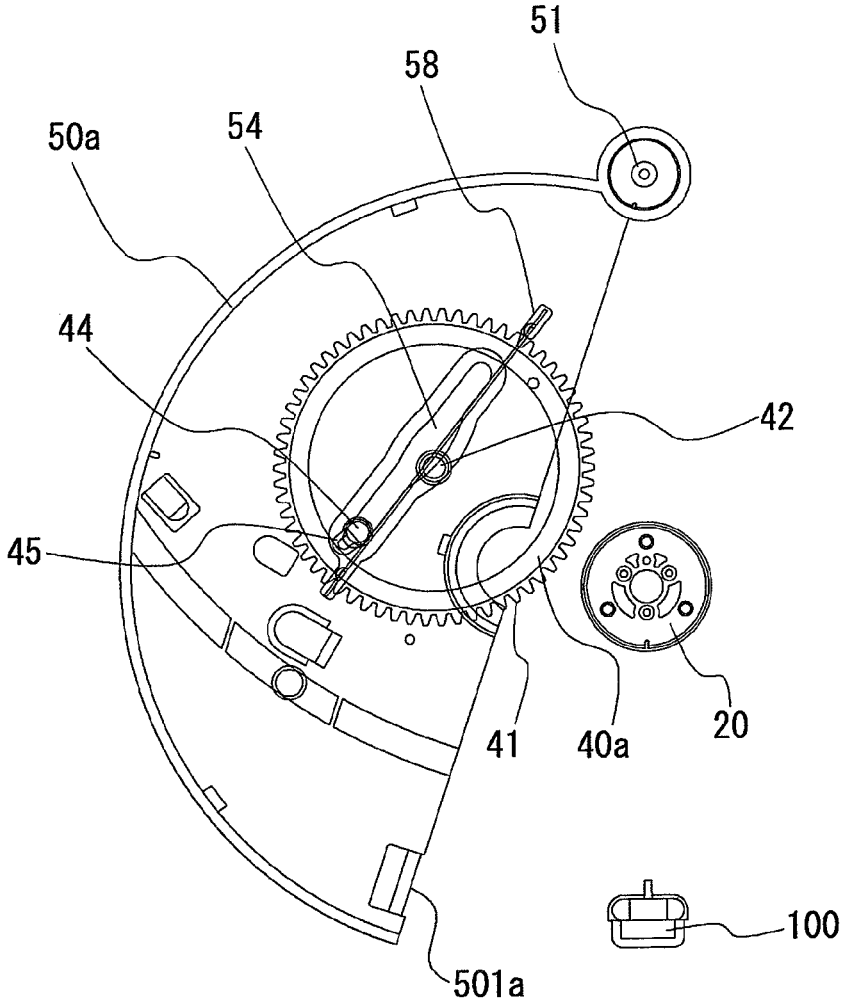
FIG. 8 is an explanatory view of the opening and closing actions.

When the gear 40*a* further rotates counterclockwise, the drive pin 44 moves out of the wide area W into the narrow areas N2 as illustrated in FIG. 8. Thus, the dial plate 50*a* attempts to return to the closing position.

Figure 9:
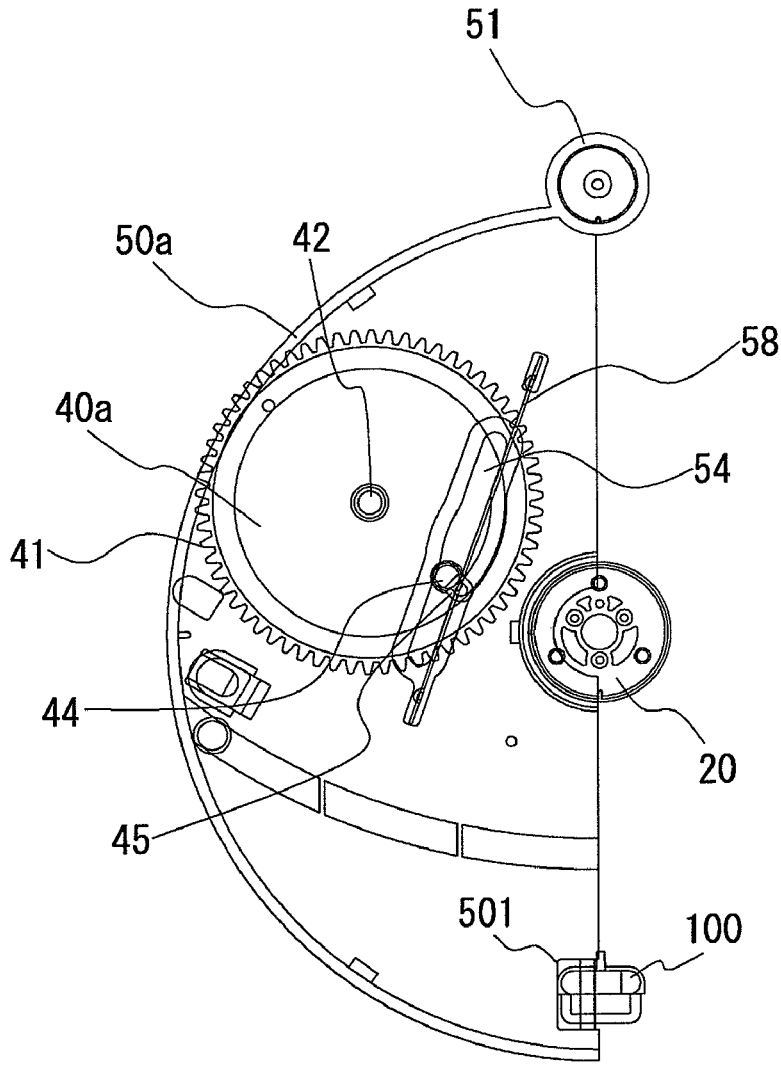
FIG. 9 is an explanatory view of the opening and closing actions.

When the gear 40*a* further rotates, the dial plate 50*a* arrives at the closing position as illustrated in FIG. 9. FIG. 9 illustrates the state immediately after the dial plate 50*a* abuts the dial plate 50*b*. This state shows immediately before the drive pin 44 moving out of the narrow areas N2 into the wide area W. That is, the dial plate 50*a* has already returned to the closing position, immediately before the drive pin 44 moves into the wide area W.

When the gear 40*a* further rotates counterclockwise, the drive pin 44 moves into the wide area W. The drive pin 44 moves into the wide area W to push the linear spring 58. The dial plate 50*a* is biased toward the dial plate 50*b* by the biasing force of the linear spring 58. When the drive pin 44 arrives at the substantial center of the wide area W, the gear 40*a* stops. That is, the state returns to the state as illustrated in FIG. 3B, again. In this way, the gear 40*a* rotates once at the time of the performance. Thus, when the gear 40*a* stops, the linear spring 58 is biased.

As described heretofore, the drive pin 44 can push the linear spring 58 in the opening state. This is because the engagement hole 54 includes the wide area W and the linear spring 58 is arranged to partially overlap the wide area W.

Meanwhile, in the closing state where the dial plates 50*a* and 50*b* close, the rattling of the dial plates 50*a* and 50*b* is suppressed by the dial plate engagement member 100, as mentioned above. However, as the dial plates 50*a* and 50*b* open, the function of suppressing the rattling with the dial plate engagement member 100 will be lost. For example, when the dial plate 50*a* opens as illustrated in FIG. 4, the dial plate engagement member 100 disengages from the abutment portion 501*a*. Therefore, the function of suppressing the rattling with the dial plate engagement member 100 will be lost.

However, in the present embodiment, the flange portion 45 overlaps the peripheral portion of the engagement hole 54 independently of the rotational position of the gear 40*a*. Accordingly, the rattling of the dial plate 50*a* is prevented. Therefore, the rattling of the dial plate 50*a* is prevented, even in an area where the function of suppressing the rattling with the dial plate engagement member 100 is lost.

Consequently, the drive pin 44 has the function of causing the linear spring 58 to have the biasing force and the function of suppressing the rattle of the dial plate 50*a*. This arrangement reduces the number of the parts.

Figure 10A:
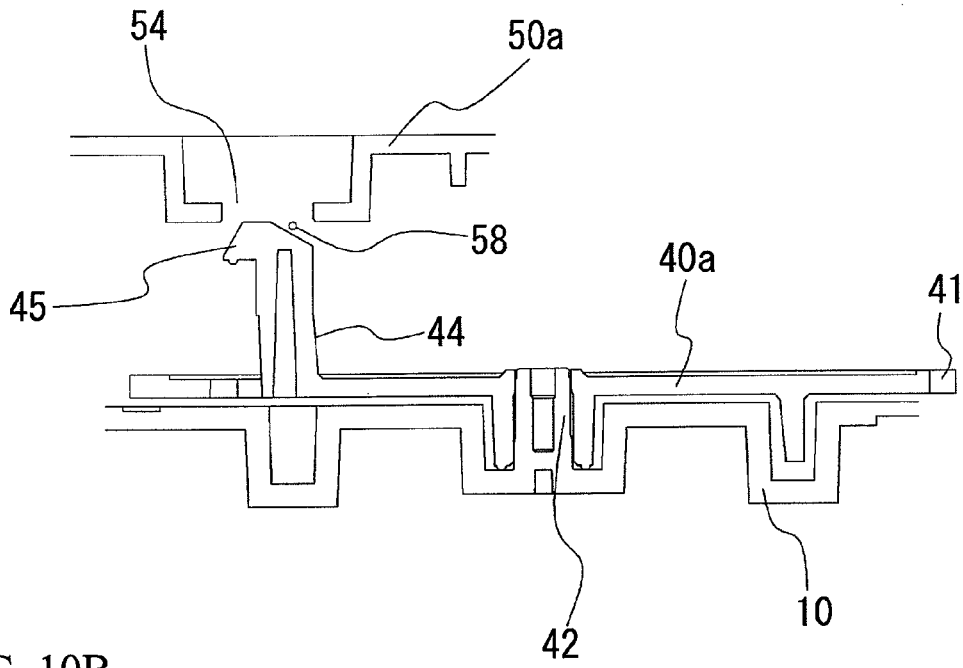
FIGS. 10A and 10B are explanatory views of assembling a dial plate.
Figure 10B:
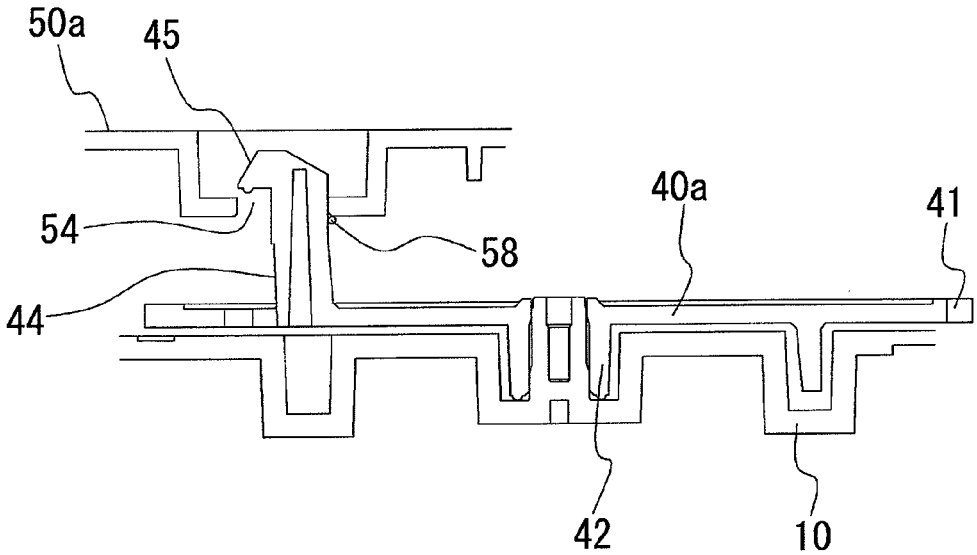

Next, the assembling of the dial plate 50*a* into the gear 40*a* will be described. FIGS. 10A and 10B are explanatory views of assembling the dial plate. FIGS. 10A and 10B illustrate cross sections in the vicinity of the drive pin 44.

First, the gear 40*a* is rotated to the position illustrated in FIG. 6. In this state, the drive pin 44 is inserted into the wide area W of the engagement hole 54. At the time of insertion, the drive pin 44 is inserted into the wide area W such that the extending direction of the flange portion 45 is along the width direction of the engagement hole 54 as illustrated in FIG. 6B.

When the drive pin 44 is inserted into the wide area W, the linear spring 58 is pushed toward the curved portion 54*b* by the flange portion 45 and the drive pin 44, and the linear spring 58 is bent as illustrated in FIGS. 10A and 10B. When the hinge portion 51 is attached to a predetermined position of the supporting plate 10 in this state, the dial plate 50*a* is moved with respect to the drive pin 44 by the restoring force of the linear spring 58 such that the flange portion 45 overlaps the peripheral portion of the engagement hole 54. In this manner, the dial plate 50*a* is connected to the gear 40*a* in the manner as illustrated in FIG. 6B.

Accordingly, the drive pin 44 including the flange portion 45 can be inserted into the engagement hole 54 with ease. This is because the engagement hole 54 includes the wide area W. Each of the widths of the narrow areas N1 and N2 is substantially identical to a body portion of the drive pin 44. Thus, when the drive pin 44 is caused to be inserted into the narrow area N1 or N2, the flange portion 45 interferes with the narrow area N1 or N2. In the result, the drive pin 44 is not inserted into the narrow area N1 or N2. However, the drive pin 44 can be inserted into the wide area W in a predetermined posture.

Additionally, it is difficult to assemble the dial plate 50*a* into the gear 40*a*, when the rotational position of the gear 40*a* is not arranged at the position illustrated in FIGS. 6A and 6B. This is because the flange portion 45 interferes with the peripheral portion of the engagement hole 54 at the time of insertion.

Next, the removal of the dial plate 50*a* from the gear 40*a* will be described with reference to FIGS. 6B, 10A, and 10B. The dial plate 50*a* in the closing state is forcibly opened in the state as illustrated in FIG. 6B. Next, the dial plate 50*a* is moved such that the drive pin 44 pushes the linear spring 58 toward the curved portion 54*b*. In this way, the linear spring 58 is bent and removed from the engagement hole 54, and the vicinity of the drive pin 44 is shifted to the state as illustrated in FIG. 10B.

In this state, the dial plate 50*a* is pulled upwardly, so that the drive pin 44 disengages from the engagement hole 54 without interference of the flange portion 45 with the engagement hole 54. In this way, the dial plate 50*a* is removable from the gear 40*a*. Since the engagement hole 54 includes the wide area W, so that the assembling work is facilitated. In addition, when the dial plate 50*a* is disposed in the fully opening position, the dial plate 50*a* is attachable to or removable from the gear 40*a*, whereby there is a low possibility of the interference the dial plate 50*a* with the dial plate 20 or 50*b* at the time of the work.

Moreover, in the state as illustrated in FIG. 3B, the dial plate 50*a* is not removable from the gear 40*a*. The flange portion 45 overlaps the linear spring 58, and the flange portion 45 interferes with the flange portion 45 when the drive pin 44 is caused to disengage from the engagement hole 54.

At the time of the performance after the assembling, even when a certain force is exerted on the dial plate 50*a* by any cause in the state as illustrated in FIG. 6B such that the drive pin 44 pushes the linear spring 58, the state is returned to the state as illustrated in FIG. 6B by the repulsive force of the linear spring 58. In this manner, the linear spring 58 prevents the drive pin 44 from disengaging from the engagement hole 54 at the time of the performance.

The present invention is not limited to the specifically described embodiments and variations but other embodiments and variations may be made without departing from the scope of the claimed invention.

A plate spring may be employed instead of the linear spring 58. When the plate spring is employed, the plate spring is secured to the dial plate 50*a* to be bendable in the planar direction of the dial plate 50*a*.

A movable member may be restricted from moving by the abutment of the movable member with the stationary member, and the movable member may be biased toward the stationary member by a biasing member.

In the present embodiment, the gear 40*a* is used for driving the dial plate 50*a*. However, the present invention is not limited to this configuration. For example, the dial plate 50*a* may be driven by an arm rotating about a predetermined position and provided with a drive pin.

What is claimed is:

1. A clockwork mechanism comprising:

a supporting member;

a movable member including an engagement hole and movably supported by the supporting member;

a drive pin engaging the engagement hole, including a flange portion for preventing the drive pin from disengaging from the engagement hole, and revolving to move the movable member;

a biasing member provided in the movable member to partially overlap the engagement hole; and an abutment member abutting the movable member to restrict the movement of the movable member, wherein:

the flange portion overlaps or does not overlap the biasing member depending on a revolving position of the drive pin;

when the movable member abuts the abutment member, the drive pin pushes the biasing member and the movable member is biased toward the abutment member by the biasing member; and when the flange portion does not overlap the biasing member, the drive pin moves the movable member to push the biasing member, allowing the drive pin to disengage from the engagement hole.

2. The clockwork mechanism of claim 1, wherein:

the engagement hole has an oblong shape and includes a narrow area and a wide area;

the biasing member is arranged along an inner edge of the narrow area;

when the drive pin is located in the wide area and the flange portion does not overlap the biasing member, the drive pin moves the movable member to push the biasing member, allowing the drive pin to disengage from the engagement hole.

3. The clockwork mechanism of claim 2, wherein the wide area allows the movable member to escape revolution of the drive pin.

4. A clockwork timepiece comprising a clockwork mechanism including:

a supporting member;

a movable member including an engagement hole and movably supported by the supporting member;

a drive pin engaging the engagement hole, including a flange portion for preventing the drive pin from disengaging from the engagement hole, and revolving to move the movable member;

a biasing member provided in the movable member to partially overlap the engagement hole; and an abutment member abutting the movable member to restrict the movement of the movable member, wherein:

the flange portion overlaps or does not overlap the biasing member depending on a revolving position of the drive pin;

when the movable member abuts the abutment member, the drive pin pushes the biasing member and the movable member is biased toward the abutment member by the biasing member; and when the flange portion does not overlap the biasing member, the drive pin moves the movable member to push the biasing member, allowing the drive pin to disengage from the engagement hole.

* * * * *